United States Patent [19]

McCoy et al.

[11] Patent Number: 4,916,874

[45] Date of Patent: Apr. 17, 1990

[54] APPARATUS AND METHOD FOR REINFORCING A CONCRETE BLOCK WALL

[76] Inventors: Donald M. McCoy, 10016 N. Krikland Ct.; James M. McCoy, 11249 N. Oriole La., both of Mequon, Wis. 53092

[21] Appl. No.: 381,783

[22] Filed: Jul. 18, 1989

[51] Int. Cl.[4] ..... E04B 2/16; E02D 27/100

[52] U.S. Cl. ..... 52/293; 52/295

[58] Field of Search ..... 52/24, DIG. 11, 23, 52/293, 294, 295, 292, 225, 229, 562

[56] References Cited

U.S. PATENT DOCUMENTS

| | | |
|---|---|---|
| 377,940 | 2/1888 | Hevner . |
| 573,452 | 12/1896 | Delahunt . |
| 1,056,810 | 3/1913 | McDonald . |
| 1,647,925 | 11/1927 | May . |
| 2,179,407 | 11/1939 | Flores . |
| 2,414,628 | 1/1947 | Battin . |
| 2,605,865 | 8/1952 | Liptay . |
| 2,635,451 | 4/1953 | Walthers . |
| 2,684,589 | 7/1954 | Perreton . |
| 2,815,656 | 12/1957 | Klein et al. . |
| 3,036,407 | 5/1962 | Dixon . |
| 3,330,084 | 7/1967 | Russell . |
| 3,357,220 | 11/1970 | Ellis . |
| 3,430,397 | 3/1969 | Ellis . |
| 3,662,507 | 5/1972 | Espeland . |
| 4,015,399 | 5/1977 | Prins . |
| 4,059,931 | 11/1977 | Mongan . |
| 4,563,852 | 1/1986 | Achtenberg et al. . |
| 4,706,428 | 11/1987 | McCoy et al. . |

*Primary Examiner*—David A. Scherbel
*Assistant Examiner*—Linda Hoffert
*Attorney, Agent, or Firm*—Andrus, Sceales, Starke & Sawall

[57] ABSTRACT

An apparatus and method for reinforcing a concrete block wall. A flexible reinforcing member, such as a chain, is adapted for placement within a vertical passage formed by cooperating cores of blocks forming the wall. The upper end of the chain is fixed to a retainer plate adapted for placement on top of the wall, and the lower end of the chain extends through an opening formed in the bottom of the wall. An anchor is adapted for connection to the foundation, and the lower end of the reinforcing member is fixed to the anchor. A portion of the floor slab above the foundation is preferably removed so that the anchor can be directly secured to the foundation. An eye bolt is connected to the upper end of the chain and has a threaded portion protecting above the retainer plate. Tension is introduced to the chain through a nut threadedly engaged with the threaded portion of the eye bolt. After tensioning of the chain, the anchor and lower end of the chain are concealed by filling in the removed portion of the floor slab with a concrete patch.

12 Claims, 1 Drawing Sheet

APPARATUS AND METHOD FOR REINFORCING A CONCRETE BLOCK WALL

BACKGROUND AND SUMMARY

This invention relates to the repair or reinforcing of walls, and more particularly to an apparatus and method for reinforcing a wall constructed of hollow concrete blocks.

A number of prior art systems are known for reinforcing a block wall. Two such systems are shown in McCoy, et al U.S. Pat. No. 4,706,428 and Achtenberg, et al, U.S. Pat. No. 4,563,852.

In the system shown in the McCoy, et al patent, a flexible reinforcing member such as a chain is inserted into a vertical passage formed by the hollow cores in consecutive courses of blocks. The upper end of the chain is fixed to an eye bolt, which has its threaded portion extending upwardly through a plate provided atop the wall. The lower end of the chain extends through an opening formed in the bottom face of the wall just above the floor slab. A plate is positioned over the opening in the face of the block wall, and the chain is fixed to the plate by means of a pin. Tension is then introduced into the chain by turning a nut threaded onto the upwardly extending threaded portion of the eye bolt. There is no connection of the chain to the foundation.

Achtenberg, et al discloses a reinforcing method in which an anchor bolt is inserted into the foundation internally of the block wall, and a reinforcing cable is then fastened to the anchor bolt. An upper opening is formed at the top of the wall, and a top bolt is placed internally of the wall so that its upper end projects above the top plate. The upper end of the steel cable is then fixed to the top bolt. Tension is introduced by turning down a nut provided on the top bolt.

The present invention is intended to provide a reinforcing apparatus and method for a concrete block wall in which a single opening is formed in the wall, and in which the anchor for the lower end of the reinforcing member is secured to the foundation exteriorly of the wall. In a preferred embodiment, the portion of the floor adjacent the bottom of the wall is removed and the anchor is secured to the foundation at the removed portion of the floor. After securing the anchor to the foundation, the floor is patched. With this construction, there is no showing on the wall of any reinforcing apparatus contained therein.

In accordance with the invention, an apparatus for reinforcing a block wall comprises an elongated reinforcing member adapted for placement within a vertical passage in the wall. Anchor means is provided for anchoring the lower end of the reinforcing member, with the anchor means being disposed exteriorly of a face of the wall and toward the bottom of the wall above the foundation. Means is provided for interconnecting the anchor means with the foundation exteriorly of the wall. Retainer means maintains the upper end of the reinforcing member in position. The retainer means is disposed toward the top of the wall and is connected to the upper end of the reinforcing member. Tensioning means is provided for tensioning the reinforcing member after the lower end of the reinforcing member is anchored to the anchor means and the upper end of the reinforcing member is connected to the retainer means. The introduction of tension into the reinforcing member reinforces the wall. The anchor means prevents upward movement of the reinforcing member when tension is introduced thereinto. In a preferred embodiment, the reinforcing member comprises a multi-link chain. The lower end of the chain preferably protrudes through an opening formed in the face of the wall adjacent the foundation. The anchor means preferably includes an upstanding portion adapted for placement against the face of the wall adjacent the opening formed therein. The upstanding portion of the anchor means preferably includes a passage and slot arrangement by which the chain is anchored to the anchor means. The anchor means further preferably includes a base portion which, in a preferred embodiment, is placed against an upwardly facing surface of the foundation where a portion of the floor slab typically placed thereabove has been removed. Fasteners, such as anchor bolts, extend between the base portion of the anchor means and the foundation for securing the anchor means to the foundation. The upstanding portion of the anchor means preferably includes a laterally extending projection adapted for placement in the opening through the wall and extending therethrough, for guiding the chain through the opening and preventing the chain from bearing on the portion of block adjacent the opening.

The invention further contemplates a method of reinforcing a block wall substantially in accordance with the above-noted summary of the reinforcing apparatus. In accordance with the method, the elongated reinforcing member is placed in one of the passages in the wall such that its lower end extends through an opening formed in the face of the wall and toward the bottom of the wall. Anchor means is provided, and the lower end of the reinforcing member is connected to the anchoring means. The anchoring means is then secured to the foundation. Retaining means is provided for maintaining the upper end of the reinforcing member in position, and tension is then introduced into the reinforcing member for reinforcing the wall. A floor slab is typically placed above the foundation at the bottom of the wall, and the method preferably contemplates removal of a portion of the floor slab adjacent the bottom of the wall. In this manner, the anchoring means can be placed directly onto the upper surface of the foundation and secured thereto. After the wall has been reinforced in accordance with the above-described steps, the removed portion of the floor can then be replaced so as to cover the anchoring means. Accordingly, there is no evidence on the exposed portion of the wall that the wall has been reinforced.

BRIEF DESCRIPTION OF THE DRAWINGS

The drawings illustrate the best mode presently contemplated of carrying out the invention.

In the drawings.

DETAILED DESCRIPTION OF THE PREFERRED EMBODIMENT

Reference is made to McCoy, et al, U.S. Pat. No. 4,706,428, the disclosure of which is hereby incorporated by reference.

Figure 1:
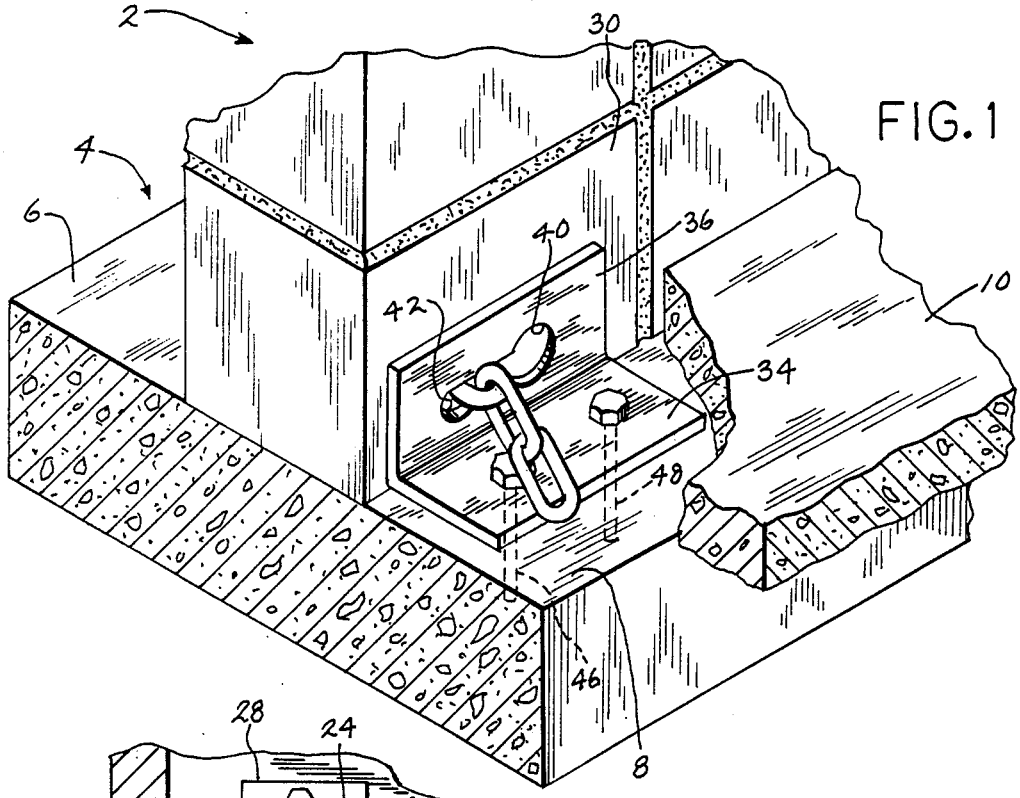
FIG. 1 is a partial isometric view of a foundation with a block wall constructed thereon, showing the lower portion of the reinforcing apparatus of the invention.

As shown in FIG. 1, a block wall 2 is constructed on a foundation 4, as is known in the art. Block wall 2 is placed on foundation 4 such that outer and inner upwardly facing portions 6 and 8, respectively, of foundation 4 are exposed. An interior floor slab 10 is formed above inner upwardly facing portion 8 of foundation 4 against the bottom of block wall 2. In accordance with known construction procedures, backfill 12 (FIG. 2) is placed over outer upwardly facing surface 6 of foundation 4 and against the outer surface of block wall 2.

Figure 2:
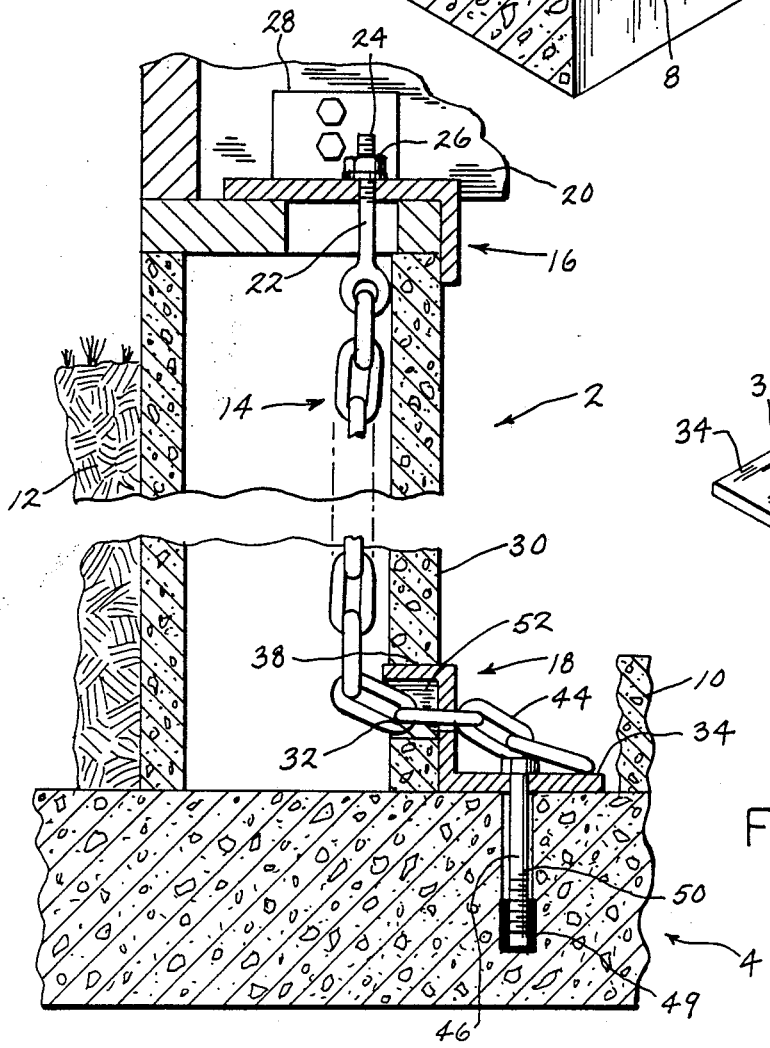
FIG. 2 is a sectional view through the block wall and foundation of FIG. 1, showing the reinforcing apparatus and of the invention.
Figure 3:
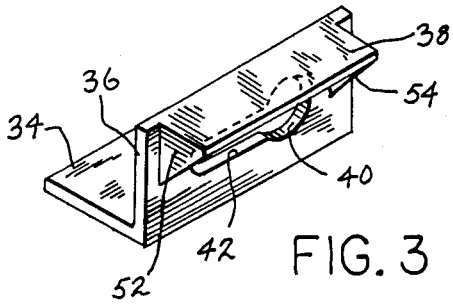
FIG. 3 is an isometric view of the anchoring means forming a part of the reinforcing apparatus shown in FIGS. 1 and 2.

As shown in FIG. 2, an apparatus for reinforcing block wall 2 includes a chain 14, an upper retainer plate 16, and a lower anchoring plate 18. Chain 14 is adapted for placement within a substantially vertical passage formed in block wall 2 by cooperating block cores, as is known.

Top plate 16 is placed atop block wall 2 between floor joists, one of which is shown at 20, in substantially the same manner as is described and discussed in McCoy, et al. U.S. Pat. No. 4,706,428. An eye bolt shown at 22 is fixed to the upper end of chain 14. Each eye bolt is provided with an upwardly projecting threaded portion, such as shown at 24, which extends upwardly through an opening formed in the upper surface of plate 16. A nut 26 is threadedly engaged with threaded portion 24. A pair of ears, one of which is shown at 28, are formed at the ends of the upper surface of top plate 16, and are adapted for connection to the joists, such as 20, between which plate 16 is placed.

Referring to FIGS. 1 and 2, the portion of floor slab 10 above inner upwardly facing surface 8 of foundation 4 is removed so as to expose the full height of the lowermost block, shown at 30, in line with the passage within which chain 14 is placed. An opening 32 is formed in the inner face of block 30 below the upper surface of floor slab 10. The lower end of chain 14 passes through opening 32 in block 30.

Anchor 18 includes a base portion 34, an upstanding portion 36, and a rearwardly extending projection 38 formed at the upper end of upstanding portion 36. As seen, base portion 34 and upstanding portion 36 cooperate to provide a substantially L-shaped cross section to the portion of anchor 18 located exteriorly of block 30.

Upstanding portion 36 is provided with a passage 40 therethrough, and a slot 42 in communication with passage 40. As shown in FIG. 1, the longitudinal axis of slot 42 is substantially parallel to the upper surface of foundation 4. When anchor 18 is in position against block 30 and atop foundation 4, passage 40 and slot 42 are both in communication with opening 32 formed in block 30.

The lower end of chain 14 is adapted to be fed through block passage 32 and through passage 40 in anchor upstanding portion 36, and then moved transversely into slot 42. As shown in FIGS. 1 and 2, the end of link 44, which forms a part of the length of chain 14, is adapted to engage the outwardly facing surface of upstanding portion 36 adjacent slot 42 so as to secure chain 14 thereto.

Base portion 34 of anchor 18 is adapted for connection to foundation 4 by means of a pair of anchor bolts, shown at 46, 48. Anchor bolt 46 (FIG. 2) is secured to an anchor 49 placed in the bottom of a bore 50 drilled into foundation 4, and anchor bolt 48 is installed likewise. In this manner, anchor 18 is securely affixed to foundation 4.

After the lower end of chain 14 is secured to anchor 18, and base portion 34 of anchor 18 is attached to foundation 4, nut 26 is turned down on threaded portion 24 of eye bolt 22 so as to introduce tension into chain 14. In this manner, reinforcing of wall 2 is accomplished.

Rearwardly extending projection 38 is adapted for placement into opening 32 in the face of block 30 and extends therethrough, as shown in FIG. 2. A pair of gusset plates, shown at 52, 54, reinforce the connection of projection 38 to upstanding portion 36. In its position as shown in FIG. 2, rearwardly extending projection 38 acts to prevent contact of chain 14 with the portion of block 30 adjacent opening 32 therethrough, so as to prevent crushing or crumbling of block 30.

Other systems could be employed for ensuring that chain 14 does not crush the block adjacent opening 32. For example, a tube could be welded to the rear of anchor upstanding portion 36 extending through opening 32.

After reinforcement of wall 2 has been accomplished in accordance with the above-noted procedure, the portion of floor slab 10 which was removed to expose upwardly facing surface 8 of foundation 4 is filled in with a concrete patch. In this manner, anchor 18 and the lower end of chain 14 are enclosed by concrete, and evidence of reinforcing on the face of block wall 2 is concealed.

Various alternatives and modifications are contemplated as being within the scope of the following claims particularly pointing out and distinctly claiming the invention.

We claim:

1. In a block wall erected on a foundation and being formed of consecutive courses of blocks, said blocks having vertical passages therein which cooperate to form a series of generally vertical passages in the wall, an apparatus for reinforcing said wall, comprising:

an elongated reinforcing member adapted for placement within one of the passages in said wall, said reinforcing member having an upper end and a lower end;

anchor means for anchoring the lower end of said reinforcing member, said anchor means being disposed exteriorly of a face of the wall and toward the bottom of the wall and above said foundation;

means interconnecting said anchor means with said foundation exteriorly of said wall;

retainer means for maintaining the upper end of said reinforcing member in position, said retainer means being disposed toward the top of the wall and being connected to the upper end of said reinforcing member; and tensioning means for tensioning said reinforcing member after the lower end of said reinforcing member is anchored to said anchor means and the upper end of the reinforcing member is connected to said retainer means to reinforce said wall, whereby said anchor means prevents upward movement of said reinforcing member when tension is introduced into said reinforcing member by use of said tensioning means.

2. The apparatus of claim 1, wherein said anchor means is disposed adjacent an opening provided in a face of said wall, said opening being disposed above said foundation, and wherein the lower end of said reinforcing member is flexible and protrudes through the opening in the face of said wall and is anchored to said anchor means.

3. The apparatus of claim 2, wherein said reinforcing member comprises a multi-link chain.

4. The apparatus of claim 3, wherein said anchor means includes an upstanding portion adapted for placement against the face of said wall adjacent said opening, said upstanding portion including a passage for receiving the lower end of said chain, and a slot in communication with said passage into which said chain is transversely movable for securing the lower end of said chain to the upstanding portion of said anchor means.

5. The apparatus of claim 2, wherein said anchor means includes a laterally extending projection adapted for placement in the opening through said wall and extending through said opening, for guiding said reinforcing member through said opening and preventing said reinforcing member from bearing on the portion of block adjacent said opening.

6. The apparatus of claim 2 wherein said anchor means includes a base portion adapted for placement on the upper surface of said foundation, and wherein said means interconnecting said anchor means with said foundation comprises fastener means securing the base portion of said anchor means to said foundation.

7. A method of reinforcing a block wall erected on a foundation, said wall being formed of consecutive courses of blocks having vertical passages therein which cooperate to form a series of generally vertical passages in the wall, comprising the steps of:

providing an elongated reinforcing member having an upper end and a lower end;

forming an opening in a face of said wall toward the bottom of said wall adjacent said foundation;

placing said reinforcing member within one of the passages in said wall such that the lower end of said reinforcing member extends through said opening in the face of said wall;

providing an anchoring means;

connecting said anchoring means to the lower end of said reinforcing member;

securing said anchoring means to said foundation;

providing retaining means for maintaining the upper end of said reinforcing member in position; and introducing tension into said reinforcing member for reinforcing said wall.

8. The method of claim 7, wherein a floor slab is placed over an upwardly facing surface of said foundation against a bottom face of said wall, and further comprising the step of removing a portion of said floor slab adjacent the bottom face of said wall so as to expose said upwardly facing surface of said foundation and to allow said anchoring means to be secured to said foundation.

9. The method of claim 8, further comprising the step of patching the removed portion of said floor slab after said anchoring means is secured to said foundation so as to cover said anchoring means.

10. The method of claim 7, wherein said anchoring means includes a base portion, and wherein the step of securing said anchoring means to said foundation comprises providing one or more fasteners extending between said base portion and said foundation.

11. The method of claim 7, wherein said anchoring means includes an upstanding portion adapted for placement against a face of said wall adjacent the opening formed therein, and wherein the step of connecting said anchoring means to the lower end of said reinforcing member comprises forming an opening in the upstanding portion of said anchoring means in communication with the opening in the face of said wall, feeding the lower end of said reinforcing member through the opening in the upstanding portion of said anchoring means, and fixing the lower end of said reinforcing member to the upstanding portion of said anchoring means.

12. The method of claim 11, wherein the step of providing a reinforcing member comprises providing a multi-link chain, and wherein the step of forming an opening in the upstanding portion of said anchoring means comprises forming a passage adapted to receive the lower end of said chain, and forming a slot in communication with said passage, and wherein the step of connecting said anchoring means to the lower end of said chain comprises moving said chain transversely into said slot such that a link of said chain is disposed within said slot and an end of an adjacent link of said chain abuts a surface of said anchoring means adjacent said slot.

* * * * *